US007014160B2

(12) United States Patent
Muyskens

(10) Patent No.: US 7,014,160 B2
(45) Date of Patent: Mar. 21, 2006

(54) WASHING MACHINE BASE FOR SECURING A CENTRAL MECHANISM

(75) Inventor: David B. Muyskens, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/709,927

(22) Filed: Jun. 7, 2004

(65) Prior Publication Data

US 2005/0269476 A1 Dec. 8, 2005

(51) Int. Cl.
*A47B 91/00* (2006.01)

(52) U.S. Cl. ..... 248/346.03; 206/592; 206/320

(58) Field of Classification Search ..... 206/765, 206/45.27, 320, 486, 488, 489, 490, 588, 206/591, 594, 784, 525.1, 592; 248/346.03, 248/346.3, 346.4, 346.5, 678, 673; 68/3 R, 68/23.3, 23 R See application file for complete search history.

(56) References Cited

U.S. PATENT DOCUMENTS

| | | | | | |
|---|---|---|---|---|---|
| 558,433 | A | * | 4/1896 | Stoddard | 248/152 |
| 1,250,770 | A | * | 12/1917 | Beach | 229/89 |
| 2,771,260 | A | * | 11/1956 | Thom | 248/524 |
| 3,048,323 | A | * | 8/1962 | Stauffer | 206/418 |
| 3,837,479 | A | * | 9/1974 | Lehmann | 206/489 |
| 4,019,672 | A | * | 4/1977 | Giannini | 206/592 |
| 4,128,171 | A | * | 12/1978 | Evans | 206/320 |
| 4,333,322 | A | | 6/1982 | Billings et al. | |
| 4,366,902 | A | | 1/1983 | Fanson et al. | |
| 4,544,351 | A | * | 10/1985 | Marsicano | 431/288 |
| 5,016,853 | A | * | 5/1991 | Cox | 248/523 |
| 5,056,341 | A | | 10/1991 | Mori et al. | |
| 5,083,845 | A | | 1/1992 | Sparks et al. | |
| 5,325,967 | A | * | 7/1994 | Gonzales | 206/462 |
| 5,934,107 | A | | 8/1999 | Lee et al. | |
| 6,053,326 | A | * | 4/2000 | Ford | 206/779 |
| 6,431,363 | B1 | * | 8/2002 | Hacker | 206/765 |

FOREIGN PATENT DOCUMENTS

| | | | | |
|---|---|---|---|---|
| JP | 3-240666 | A * | 10/1991 | 206/320 |
| JP | 04128159 | A2 | 4/1992 | |
| JP | 06156573 | A2 | 6/1994 | |
| JP | 07041075 | A2 | 2/1995 | |
| JP | 9-156680 | A * | 6/1997 | |
| JP | 09315483 | A2 | 12/1997 | |
| JP | 10236573 | A2 | 9/1998 | |

* cited by examiner

*Primary Examiner*—Ramon O Ramirez
(74) *Attorney, Agent, or Firm*—Clausen Miller, P.C.

(57) ABSTRACT

A washing machine base that protects and cushions the washing machine and secures the washing machine transmission or other mechanism suspended below the washer tub during assembly and shipping, even if the appliance is tilted. The base may be formed entirely from corrugated board and comprises a load bearing tray and an insert disposed within the tray. The tray has a bottom panel for supporting the washing machine and side panels connected to and extending upward from the bottom panel. The insert is formed from a corrugated blank that, when folded in accordion fashion, assumes a substantially pyramid shape defining a centrally disposed opening raised above the bottom panel and configured to receive and secure the washing machine mechanism.

11 Claims, 3 Drawing Sheets

WASHING MACHINE BASE FOR SECURING A CENTRAL MECHANISM

BACKGROUND OF INVENTION

This patent relates to appliance bases. More particularly, this patent relates to an appliance base that can cushion and protect a washing machine and secure a washing machine mechanism suspended below the washer tub.

Base pads, sometimes referred to as carriers, skids, pallets or simply bases, are used to cushion and protect products such as large appliances during assembly, storage and transport. Numerous appliance bases are known in the art, including bases made of wood, plastic, corrugated paper, and composite bases made of a combination of materials. Sonoco Development, Inc., the owner of the present invention, owns a number of patents in this field, including U.S. Pat. Nos. 6,155,527 and 6,264,157.

Top-loading washing machines present a special challenge for the industrial packaging industry, particularly in the design of the base. Top-load washing machines typically comprise a tub suspended from the appliance cabinet, a central pivoting agitator mounted inside the tub, and a transmission operably connected to the agitator and extending below the tub, where it is connected to a motor by a belt or coupler. The transmission and appliance cabinet are susceptible to damage from impacts as the appliance is moved during assembly and shipping. The challenge for the packaging industry has been to design a base that supports the appliance and protects the transmission and cabinet from damage. Prior to the present invention, this was accomplished by various means, including using metal struts or a number of EPS foam pieces that had to be removed after shipping.

Thus it is an object of the invention to provide an appliance base that secures the transmission and protects it from damage during assembly and shipping, even if the appliance is tilted.

Another object of the invention is to provide a base that cushions the appliance while it passes over conveyor rollers.

Yet another object of the invention is to provide a means to secure a washing machine transmission that does not require removal of packaging components upon delivery of the machine.

Yet another object of the invention is to provide a base that can be used with open sided packaging, i.e., that can be wrapped in stretch film.

Still another object of the invention is to satisfy the aforementioned objectives in a base constructed primarily of corrugated paperboard.

Further and additional objects will appear from the description, accompanying drawings, and appended claims.

SUMMARY OF THE INVENTION

The present invention is a washing machine base that protects and cushions the washing machine and secures the washing machine transmission or other mechanism suspended below the washer tub during assembly and shipping, even if the appliance is tilted. The base is corrugated to provide adequate cushioning to the appliance while it passes over conveyor rollers during assembly.

The base comprises a tray and an insert disposed within the tray. The tray comprises a flat bottom panel for supporting the washing machine and side panels extending upward from the bottom panel.

The insert is formed from a cut blank that, when folded, assumes a substantially pyramid shape with an opening at the center for receiving and securing the washing machine transmission. The insert has four sections or legs extending radially from the centrally disposed opening toward the four corners of the tray. Each leg or section comprises a pair of downwardly angled panels connected along a ridge or fold line. Each downwardly angled panel slopes downward from the fold line to an attachment panel that is affixed to the tray. Each downwardly angled panel is also attached by a fold line to an adjacent downwardly angled panel on an adjacent leg. The eight downwardly angled panels (two panels per leg times four legs) define the centrally disposed opening that receives and secures the washing machine mechanism. The centrally disposed opening is raised (elevated) above the tray bottom panel. Optional foam members may be adhered to the tray corners. The foam members and tray define slots for receiving vertical support posts.

Upon delivery, the base can be easily removed from the appliance in a single piece, thereby eliminating the need to remove multiple packaging components from the underside of the appliance. The base can be used with a top cap, four vertical support posts and clear stretch wrap to create a see-though package. The vertical support posts provide axial compression strength and enable multiple packaged appliances to be stacked on top of one another. The base may be constructed entirely or predominately of corrugated board and so is readily recyclable.

DETAILED DESCRIPTION

The present invention is described as a base for a washing machine, although it is to be understood that the invention could be used with any appliance or machine that can be supported by a flat base panel but has a centrally suspended portion that must be secured during assembly and shipping.

Top-loading washing machines typically comprise a wash tub suspended from the appliance cabinet, a central pivoting agitator mounted inside the tub, and a transmission operably connected to the agitator and extending below the tub where it is connected to a motor by a belt or coupler. The transmission is susceptible to damage from impacts as the appliance is moved during assembly and shipping, particularly if the transmission is allowed to swing freely. The present invention is an appliance base 10 which secures the transmission or other mechanism extending below the washer tub to prevent damage to the mechanism during assembly and shipping, even if the appliance is tilted.

Figure 1:
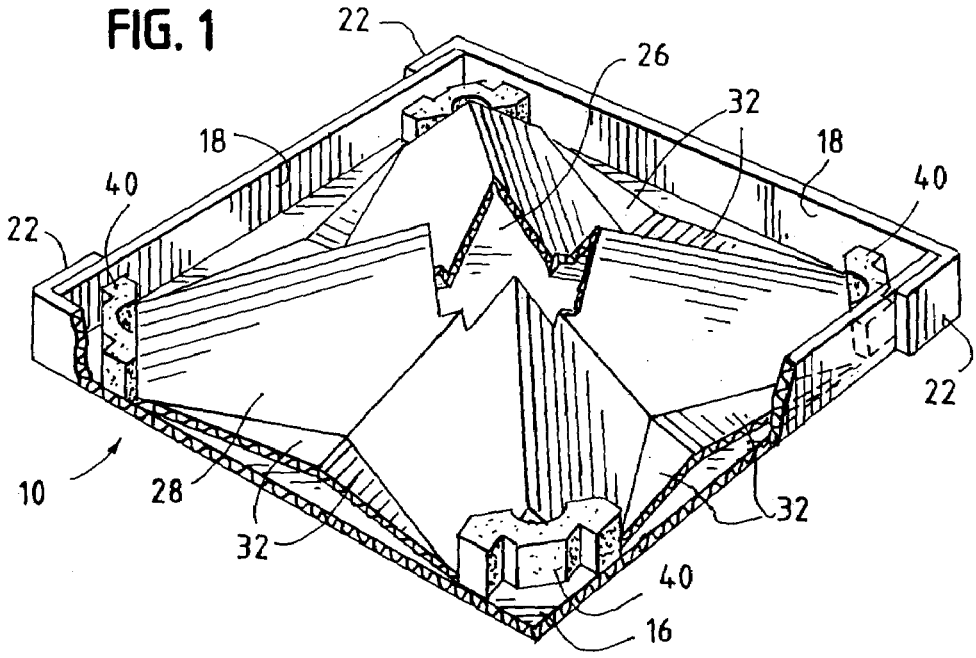
FIG. 1 is a perspective view of an appliance base according to the present invention.
Figure 5:
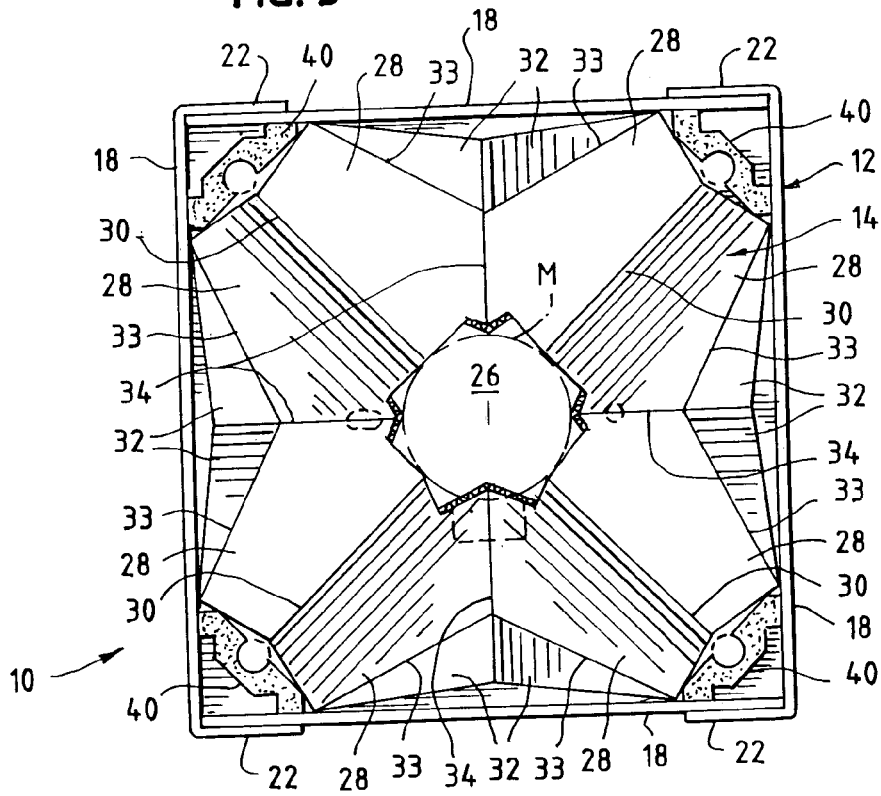
FIG. 5 is a top view of the appliance base of FIG. 1.
Figure 6:
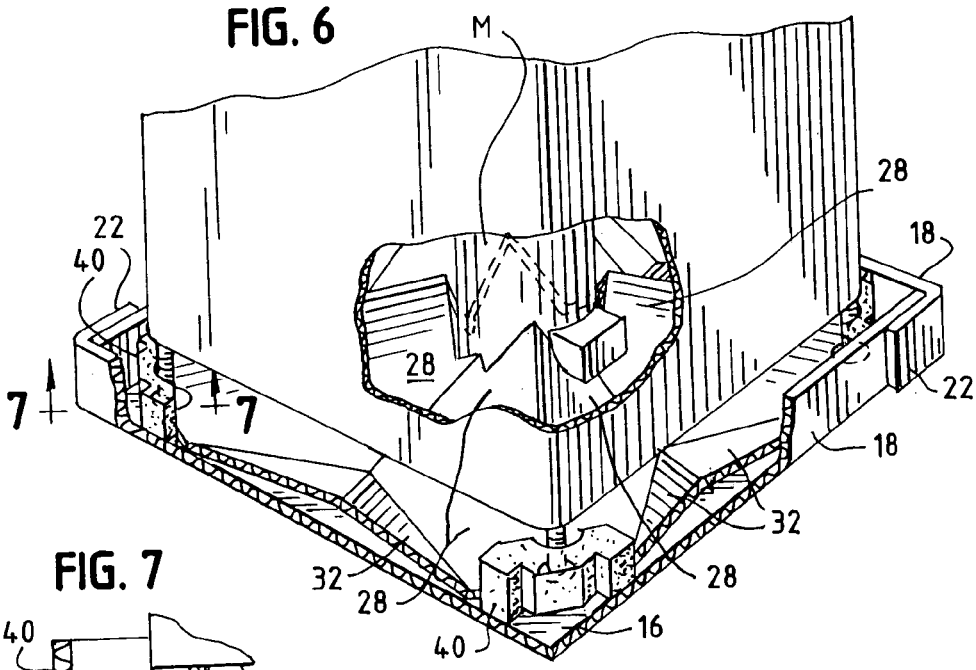
FIG. 6 is a perspective view of the appliance base of FIG. 1 shown mounted under a washing machine, the washing machine shown in cutaway view to show how the base secures a part of the washing machine suspended beneath the washer tub.

Turning to the drawings, there is shown in FIGS. 1, 5 and 6 one embodiment of the present invention, an appliance base 10 for cushioning and protecting a washing machine and securing the washing machine mechanism extending below the washer tub during assembly and shipping. Typically, the mechanism is a transmission and/or motor suspended below the tub and operably connected to an agitator mounted within the tub. The base 10 comprises a substantially rectangular tray 12 and an insert 14 mounted within the tray 12 which secures the washing machine mechanism. Preferably both pieces are made from corrugated paperboard.

Figure 2:
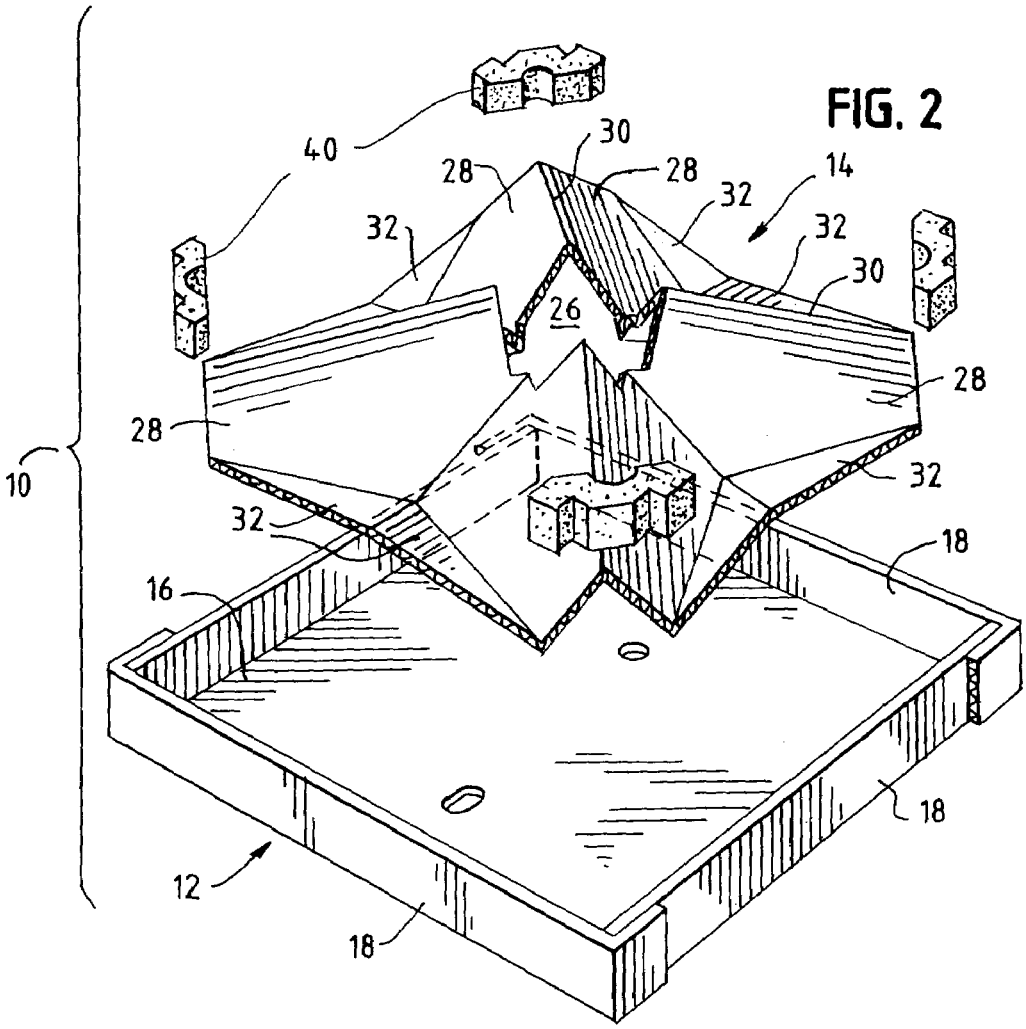
FIG. 2 is an exploded perspective view of the appliance base of FIG. 1 comprising a tray 12 and an insert 14.
Figure 4:
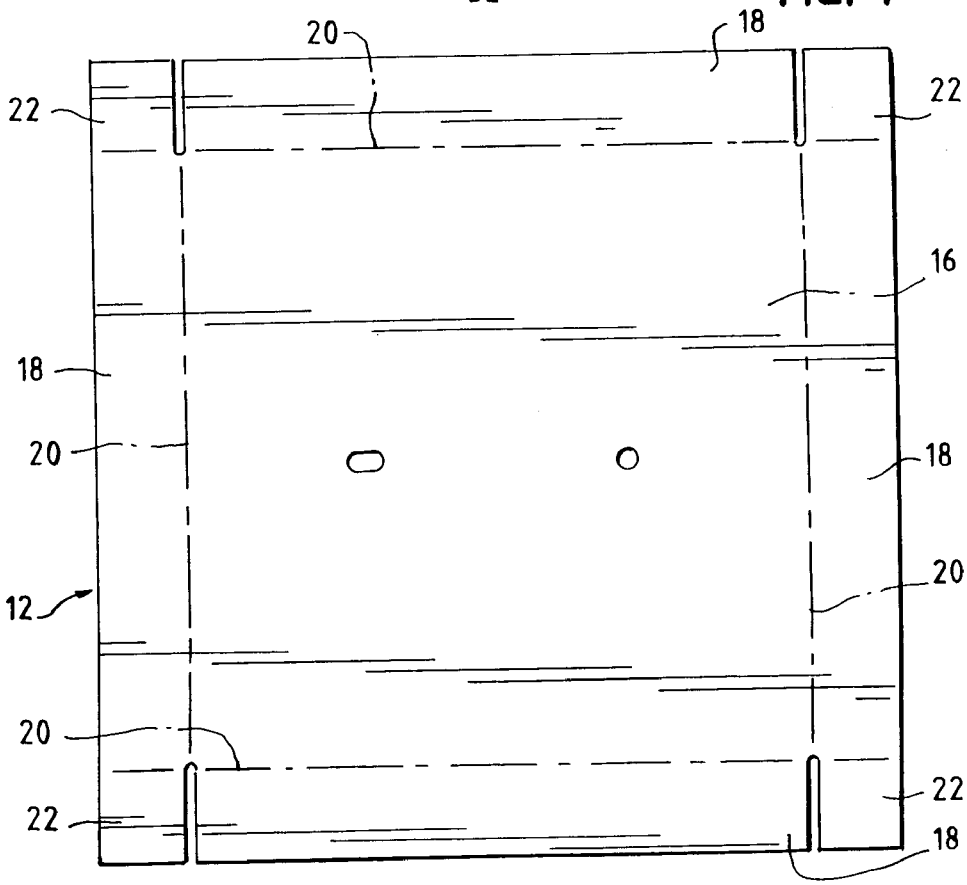
FIG. 4 is a top view of a blank used to form the tray of FIG. 2.

As best shown in FIGS. 2 and 4, the tray 12 is made from a blank having a rectangular bottom panel 16 and four upwardly extending side panels 18 attached to the bottom panel 16 along fold lines 20. For the purposes of the description and claims, a diagonal is a straight line extending from one corner of the tray bottom panel 16 to the diagonally opposite corner, and an orthogonal line is a straight line lying at right angles to an edge of the tray bottom panel 16.

To assemble the tray 12, the side panels 18 are folded upright by folding the blank along fold lines 20. Then each side tab 22 is brought into contact with the outer face of the adjacent orthogonally disposed side panel 18 and glued or otherwise affixed thereto. In the assembled tray 12, the bottom panel 16 and each pair of orthogonal side panels 18 define a corner. The side panels 18 provide some protection for the bottom part of the appliance cabinet (see FIG. 6) and help secure corner posts (not shown) in place.

The insert 14 is a complex three-dimensional shape vaguely resembling a pyramid. The insert 14 comprises four sections or legs extending radially from a centrally disposed opening 26 toward the four corners of the tray 12. Each leg comprises a pair of downwardly angled panels 28 connected along a diagonal fold line or ridge 30. As best shown in FIG. 5, the diagonal fold lines 30 are aligned with the diagonals of the tray bottom panel 16. Each angled panel 28 slopes downward from the ridge 30 to a horizontal attachment panel 32 that is glued or otherwise affixed to the bottom panel 16 of the tray 12. The attachment panels 32 are connected to the angled panels 28 along basal fold lines 33. Preferably, the attachment panels 32 are triangular.

There are eight angled panels 32. Each angled panel 28 is also attached to an adjacent angled panel 28 on an adjacent leg by an orthogonal fold line 34. The orthogonal fold lines 34 are aligned with the orthogonally bisecting lines of the tray bottom panel 16, as best shown in FIG. 5.

Figure 3:
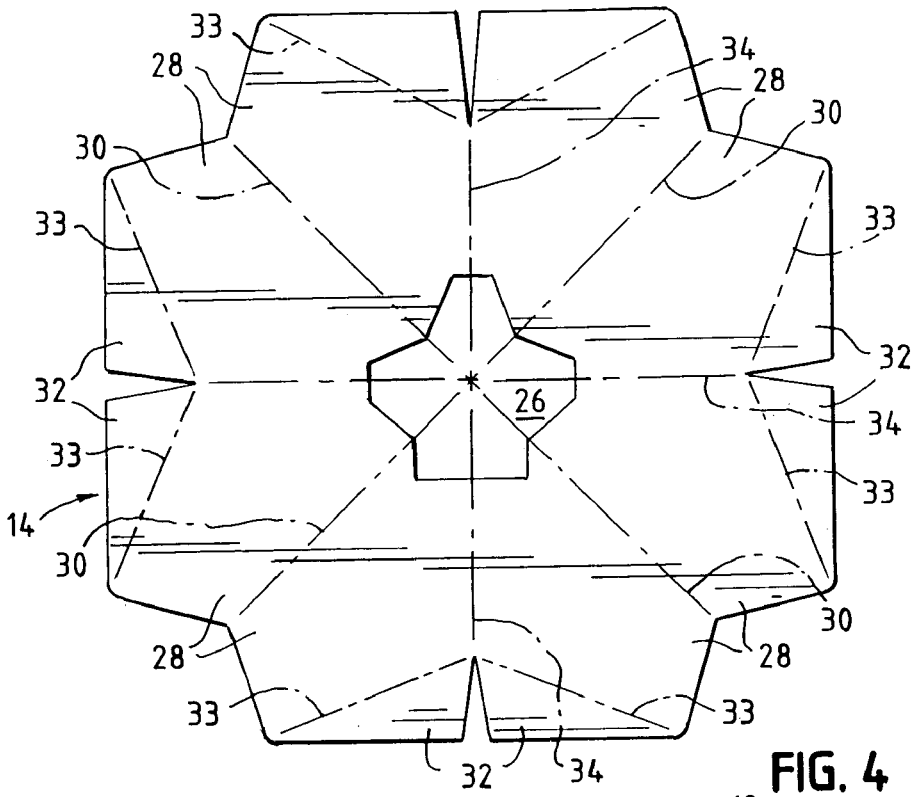
FIG. 3 is a top view of a blank used to form the insert of FIG. 2.

The insert 14 may be made by first cutting a blank into the shape shown in FIG. 3, including cutting out the centrally disposed opening 26 and perforating the blank to create the fold lines 30, 33 and 34. Next, the blank is folded in accordion fashion along fold lines 30 and 34 and along basal fold lines 33 to create the three-dimensional insert 14 best shown in FIG. 2.

The insert 14 does not bear any of the appliance load. Rather, its sole function is to secure the washing machine mechanism M (FIGS. 5 and 6) during handling and shipping so that the transmission does not damage itself or other parts of the washing machine.

After making the tray 12 and insert 14 as described above, the base 10 is assembled by placing the insert 14 within the tray 12 and gluing or otherwise affixing the attachment panels 32 of the insert 14 to the bottom panel 16 of the tray 12. The attachment panels 32 should mate face-to-face with the bottom panel 16.

As best shown in FIGS. 5 and 6, the angled panels 28 define the centrally disposed opening 26 that receives the washing machine mechanism M suspended below the washer tub and stabilizes it during movement. The opening 26 is raised (elevated) above the tray bottom panel 16 and should be just large enough to accommodate the mechanism M, for example, six to seven inches (15 to 128 cm) in diameter.

Figure 7:
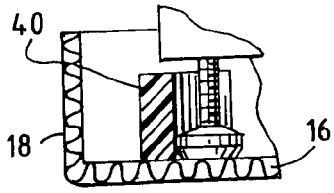
FIG. 7 is a cross-sectional view taken along line 7—7 of FIG. 6.

Optional foam members 40 may be adhered to or wedged in the corners of the tray 12 to help cushion the appliance and position the vertical support posts (not shown) which fit between the foam members 40 and the tray side panels 18. Openings may be formed in the foam members 40 for receiving appliance feet (see FIG. 7). The foam members 40, bottom panel 16 and side panels 18 define slots or spaces for receiving the vertical support posts.

Thus there has been described a washing machine base that protects and cushions a washing machine and secures the washing machine transmission or other mechanism suspended below the washer tub during assembly and shipping, even if the appliance is tilted. Preferably the base tray is corrugated to provide adequate cushioning to the appliance while it passes over conveyor rollers during assembly. Upon delivery, the base can be easily removed in a single piece, thereby eliminating the need to remove multiple packaging components from the underside of the appliance. The base tray has short side panels so the base can be used with open sided packaging. For instance, the base can be used with a top cap, four corner posts and clear stretch wrap to create a see-though package. The corner posts provide axial compression strength and enable multiple packaged appliances to be stacked on top of one another. The base may be constructed entirely or predominately of corrugated board and so is readily recyclable.

Other modifications and alternative embodiments of the invention are contemplated which do not depart from the scope of the invention as defined by the foregoing teachings and appended claims. It is intended that the claims cover all such modifications that fall within their scope.

What is claimed is:

1. An appliance base for a washing machine of the type having a wash tub and a mechanism extending below the wash tub, the base comprising:

a tray having a substantially flat rectangular bottom panel for supporting the washing machine; and an insert disposed within the tray and having a centrally disposed opening for receiving and securing the washing machine mechanism, the insert being formed from a single cut and folded blank;

wherein the tray further comprises four corners and the insert further comprises four legs extending radially from the centrally disposed opening toward the four corners of the tray, each leg comprising a pair of downwardly angled panels connected along a first fold line extending from the centrally disposed opening, each downwardly angled panel sloping downward from the first fold line to an attachment panel that mates face-to-face with and is affixed to the bottom panel of the tray, each downwardly angled panel and the corresponding attachment panel forming an obtuse angle.

2. The appliance base of claim 1 wherein the first fold lines are diagonally oriented with respect to the bottom panel.

3. The appliance base of claim 2 wherein the attachment panels are connected to the downwardly angled panels along second fold lines.

4. The appliance base of claim 3 wherein each downwardly angled panel is attached to an adjacent downwardly angled panel on an adjacent leg by a third fold line.

5. The appliance base of claim 4 wherein each third fold line is aligned with an orthogonally bisecting line of the tray bottom panel.

6. The appliance base of claim 1 wherein the downwardly angled panels define the centrally disposed opening.

7. The appliance base of claim 6 wherein the centrally disposed opening is raised above the tray bottom panel.

8. The appliance base of claim 1 wherein the tray further comprises side panels connected to and extending upward from the bottom panel.

9. The appliance base of claim 8 further comprising members adhered to the tray and wherein the members, bottom panel and side panels define slots for receiving vertical support posts.

10. The appliance base of claim 9 wherein the members have openings formed therein.

11. The appliance base of claim 1 wherein the tray and insert are formed from corrugated board.

* * * * *